US008115783B2

(12) United States Patent
Nystad et al.

(10) Patent No.: US 8,115,783 B2
(45) Date of Patent: Feb. 14, 2012

(54) METHODS OF AND APPARATUS FOR PROCESSING COMPUTER GRAPHICS

(75) Inventors: Jorn Nystad, Trondheim (NO); Erik Faye-Lund, Trondheim (NO)

(73) Assignee: ARM Norway AS, Trondheim (NO)

( * ) Notice: Subject to any disclaimer, the term of this patent is extended or adjusted under 35 U.S.C. 154(b) by 918 days.

(21) Appl. No.: 12/068,007

(22) Filed: Jan. 31, 2008

(65) Prior Publication Data

US 2009/0195555 A1 Aug. 6, 2009

(51) Int. Cl.
*G09G 5/00* (2006.01)

(52) U.S. Cl. ..... 345/620

(58) Field of Classification Search ..... 345/620–628
See application file for complete search history.

(56) References Cited

U.S. PATENT DOCUMENTS

| | | | | |
|---|---|---|---|---|
| 5,016,169 | A | 5/1991 | Koya et al. | |
| 5,644,752 | A | 7/1997 | Cohen et al. | |
| 5,929,862 | A | 7/1999 | Barkans | |
| 6,052,129 | A * | 4/2000 | Fowler et al. | 345/620 |
| 6,057,855 | A | 5/2000 | Barkans | |
| 6,128,000 | A | 10/2000 | Jouppi et al. | |
| 6,216,200 | B1 | 4/2001 | Yeager | |
| 6,259,460 | B1 * | 7/2001 | Gossett et al. | 345/552 |
| 6,260,131 | B1 | 7/2001 | Kikuta et al. | |
| 6,424,343 | B1 | 7/2002 | Deering et al. | |
| 6,424,345 | B1 | 7/2002 | Smith et al. | |
| 6,504,542 | B1 * | 1/2003 | Voorhies et al. | 345/441 |
| 6,633,297 | B2 | 10/2003 | McCormack et al. | |
| 6,650,325 | B1 * | 11/2003 | Voorhies et al. | 345/426 |
| 6,650,333 | B1 | 11/2003 | Baldwin | |
| 6,697,063 | B1 | 2/2004 | Zhu | |
| 6,720,975 | B1 | 4/2004 | Dietrich, Jr. | |
| 6,766,410 | B1 | 7/2004 | Carlton | |
| 6,967,663 | B1 | 11/2005 | Bastos et al. | |
| 7,170,515 | B1 | 1/2007 | Zhu | |
| 7,184,041 | B2 | 2/2007 | Heng et al. | |
| 7,292,242 | B1 * | 11/2007 | Wittenbrink et al. | 345/421 |

(Continued)

FOREIGN PATENT DOCUMENTS

EP 0 910 047 4/1999

(Continued)

OTHER PUBLICATIONS

Sim Dietrich, "Guard Band Clipping in Direct3D," NVIDIA Corporation, pp. 1-7.

(Continued)

*Primary Examiner* — Ryan R Yang
(74) *Attorney, Agent, or Firm* — Nixon & Vanderhye P.C.

(57) ABSTRACT

In a graphics processing system, the left, right, top and bottom edge planes for the purposes of clipping are set to the maximum values that can be represented using floating-point format numbers, vertex positions are snapped to a grid of predefined vertex positions, and the precision of selected vertices is prioritized when deriving edge functions for a given primitive. In respect of the depth near and far clipping planes, those planes are set to the maximum floating-point number format that can be represented for "Z" in the graphics system, but then fragments that have a Z value that falls outside the range zero to one are discarded using a depth test. In respect of the eye-plane, the need for clipping is avoided by modifying edge equations generated for a primitive in dependence on the sign of a "W" value for each vertex of the primitive.

19 Claims, 4 Drawing Sheets

U.S. PATENT DOCUMENTS

| | | | |
|---|---|---|---|
| 7,454,590 | B2 | 11/2008 | Jordan et al. |
| 7,554,538 | B2 | 6/2009 | Wexler et al. |
| 7,656,417 | B2 | 2/2010 | Seiler et al. |
| 7,692,654 | B1 | 4/2010 | Donham |
| 7,774,531 | B1 | 8/2010 | Karisson |
| 7,814,292 | B2 | 10/2010 | Tsien |
| 2002/0130886 | A1 | 9/2002 | Baldwin |
| 2002/0171658 | A1 | 11/2002 | Ramani et al. |
| 2002/0180747 | A1 | 12/2002 | Lavelle et al. |
| 2003/0117409 | A1 | 6/2003 | Lefebvre et al. |
| 2003/0165147 | A1 | 9/2003 | Shimada |
| 2003/0179199 | A1 | 9/2003 | Deering et al. |
| 2005/0002371 | A1 | 1/2005 | Anderson |
| 2005/0044319 | A1 | 2/2005 | Olukotun |
| 2005/0225670 | A1 | 10/2005 | Wexler et al. |
| 2006/0184753 | A1 | 8/2006 | Jeter et al. |
| 2007/0050601 | A1 | 3/2007 | Chaudhry et al. |
| 2007/0067505 | A1 | 3/2007 | Kaniyur et al. |
| 2007/0106874 | A1 | 5/2007 | Pan et al. |
| 2007/0229503 | A1 | 10/2007 | Witzel et al. |
| 2008/0320230 | A1 | 12/2008 | Vishin et al. |

FOREIGN PATENT DOCUMENTS

| | | |
|---|---|---|
| GB | 2 368 763 | 5/2002 |
| GB | 2444 598 | 6/2008 |
| WO | WO 99/45502 | 10/1999 |
| WO | WO 2005/091227 | 9/2005 |

OTHER PUBLICATIONS

Glide 2.2 Programming Guide, Programming the 3Dfx Interactive Glide™ Rasterization Library 2.2, Document Release 014, Mar. 8, 2007, pp. 1-168.

Related U.S. Appl. No. 12/068,001, filed Jan. 31, 2008; Inventor: Nystad.

Related U.S. Appl. No. 11/791,753, filed May 29, 2007; Inventor: Nystad et al.

U.S. Appl. No. 12/068,009, filed Jan. 31, 2008; Inventor: Sorgard et al.

U.S. Appl. No. 12/068,010, filed Jan. 31, 2008; Inventor: Nystad et al.

U.S. Appl. No. 12/068,012, filed Jan. 31, 2008; Inventor: Nystad et al.

U.S. Appl. No. 12/588,666, filed Oct. 22, 2009, Nystad et al.

Office Action mailed Jun. 27, 2011 in co-pending U.S. Appl. No. 12/929,956.

Office Action mailed May 27, 2010 in co-pending U.S. Appl. No. 11/791,753.

Office Action mailed Jul. 9, 2010 in co-pending U.S. Appl. No. 12/068,010.

Office Action mailed Jul. 9, 2010 in co-pending U.S. Appl. No. 12/068,012.

Office action mailed Jan. 31, 2011 in co-pending U.S. Appl. No. 12/068,010.

Office action mailed Feb. 8, 2011 in co-pending U.S. Appl. No. 12/068,012.

Office Action mailed Nov. 23, 2010 in co-pending U.S. Appl. No. 12/068,009.

Product review of ATI RADEON 9700 PRO Preview, Aug. 2002, www.firingsquad.com, 44 pages.

T. Akenine-Moller, "FLIPQUAD: Low-Cost Multisampling Rasterization" Chalmers University of Technology Technical Report 02-04, Apr. 2002, pp. 1-4.

International Search Report and Written Opinion of the International Searching Authority mailed Feb. 27, 2006 in PCT/GB2005/004573.

UK Search and Examination Report dated Feb. 25, 2010 for GB 0918690.9.

International Search Report mailed Jun. 26, 2008 in European Application No. GB0801812.9.

UK Search Report dated Jan. 30, 2009 for GB 0819570.3.

D. Kim et al, "An SoC With 1.3 Gtexels/s 3-D Graphics Full Pipeline for Consumer Applications" IEEE Journal of Solid-State Circuits, vol. 41, No. 1, Jan. 2006, pp. 71-84.

H. Igehy et al, "Prefetching in a Texture Cache Architecture" 1998, Eurographics/SIGGRAPH Workshop on Graphics Hardware.

D. Blythe, "The Direct3D 10 System" 2006, ACM.

"Cray MTA" http://www.cmf.nrl.navy.mil/CCS/help/mta/ 2002.

R. Rajwar et al, "Speculative Lock Elision: Enabling Highly Concurrent Multithreaded Execution" MICRO '01, Dec. 2001.

A. Ho et al, "On deadlock, livelock, and forward progress" Technical Report No. 633, University of Cambridge Computer Laboratory, May 2005, pp. 1-8.

T. Li et al, "Spin Detection Hardware for Improved Management of Multithreaded Systems" IEEE Transactions on Parallel and Distributed Systems, vol. 17, No. 6, Jun. 2006, pp. 508-521.

S. Abdelwahed et al, "Blocking Detection in Discrete Event Systems" 6 pages.

P. Beaudoin et al, "Compressed Multisampling for Efficient Hardware Edge Antialiasing" *Proceedings of Graphics Interface*, May 2004, pp. 169-176.

* cited by examiner

METHODS OF AND APPARATUS FOR PROCESSING COMPUTER GRAPHICS

The technology described in this application relates to the processing of computer graphics, and in particular to a method of and an apparatus for reducing clipping when processing computer graphics.

The technology described in this application will be described with particular reference to the processing of three dimensional graphics, although as will be appreciated by those skilled in the art, it is applicable to the processing of two-dimensional graphics as well.

3D graphics processing is normally carried out by first splitting the scene to be displayed into a number of similar basic components (so-called "primitives") to allow the 3D graphics processing operations to be more easily carried out. These "primitives" are usually in the form of simple polygons, such as triangles.

Primitives to be rendered are typically defined by defining the vertices that make up the primitives. Each vertex also will have associated with it particular data values representing the primitive at the vertex position. The data values include the X and Y position of the vertex, the depth (Z) value for the primitive, a W (eye plane distance) value for the primitive, colour and transparency values (i.e. RGBA) values for the primitive at the vertex, etc.

The primitives initially defined for a scene to be displayed typically undergo a process known as transform and lighting (T & L), in which the initially defined primitives can undergo various geometric transformations to alter their positions (and shapes and sizes) in the scene, and also have lighting "effects" applied to them (to, in effect, modify their colours and appearance on the basis of light sources and effects, etc., defined for the scene).

Once the scene to be displayed has been divided into a plurality of graphics primitives, and the primitives have been transformed and lit, the graphics primitives are usually then further divided into discrete graphical entities or elements, usually referred to as "fragments", on which the actual graphics processing operations (such as rendering operations) are carried out. Each such graphics fragment will represent and correspond to a given position or positions in the primitive and comprise, in effect, a set of data (such as colour and depth values) for the position or positions in question.

Each graphics fragment (data element) may correspond to a single pixel (picture element) in the final display, or it can be the case that there is not a one-to-one correspondence between "fragments" and display "pixels", for example where particular forms of post-processing such as downscaling are carried out on the rendered image prior to displaying the final image.

Thus two aspects of 3D graphics processing that are typically carried out are the "rasterising" of graphics "primitive" (or polygon) position data to graphics fragment position data (i.e. determining the (x, y) positions of the graphics fragments to be used to represent each primitive in the scene to be displayed), and then "rendering" the "rasterised" fragments (i.e. colouring, shading, etc., the fragments) for display on a display screen.

(In 3D graphics literature, the term "rasterisation" is sometimes used to mean both primitive conversion to fragments and rendering. However, herein "rasterisation" will be used to refer to converting primitive data to fragment addresses only.)

Prior to the rasterisation and rendering stages of graphics processing, there is also usually a stage that may be referred to as primitive or triangle "set-up". This stage uses the data defined for each vertex of a given primitive to derive, inter alia, various "line" functions for each primitive, such as, and including, "edge functions" that will represent the geometric edges of the primitive, and other functions, commonly referred to as "interpolation functions", that represent the way that the data values, such as the colour values, etc., will vary across the primitive.

The edge functions for a primitive are derived by taking the two vertices that define a geometric edge of the primitive, and then deriving, using the positions of those vertices, a function that represents the edge (line) extending between the vertices. This edge function is then used in particular during the rasterisation process, to determine whether given x, y fragment positions either lie inside the primitive or outside the primitive.

The interpolation functions for a primitive are derived in a similar manner. For example, a function that defines a weight between the relevant data values, such as the colour values, at the vertices of the primitive is set up. This is done for each respective vertex attribute for the primitive, such that there will then be interpolation functions defined in respect of each appropriate different class of data values for the primitive. The interpolation functions can then be used to derive the appropriate data value for any position within the primitive (e.g. by evaluating the interpolation function for the given x, y position and calculating a weighted sum to get the final data (attribute) value at the x, y position).

In 3D graphics processing, rendering conceptually takes place within a so-called "view frustum", which is, in effect, a box in front of the viewer's (the view) position which effectively represents the three dimensional volume within which primitives may need to be rendered for display.

The view frustum is effectively defined by having top, left, bottom and right edge planes which, in effect, define a "viewport" representing the edges of the view frustum, and depth near and far planes which represent the front and back planes of the view frustum (representing the closest and furthest distances at which objects can appear). The viewport typically corresponds to the size of the display screen.

In many graphics processing systems, it has been felt desirable to only render the parts of the scene that will actually be seen, i.e. will only appear within the screen itself. This is so as to avoid redundantly rendering, for example, primitives that may lay outside the visible area of the scene and so will never in practice be seen.

In order to achieve this, it is known to "clip" primitives against the view frustum viewport edges (in effect against the edges of the display screen). "Clipping" involves testing the positions of primitives against the positions of the viewport edge planes, to see whether the primitive will extend beyond the edge of the viewport or not. A similar process is carried out in respect of the near and far depth planes.

In a "clipping" system, if it is found that a primitive extends beyond, for example, one of the viewport edge planes, then instead of rasterising or rendering the primitive as it is originally defined, the primitive is "clipped" at the relevant edge plane of the viewport so that only the part of the primitive appearing within the viewport will be rasterised and rendered.

(A primitive may lie partially outside the viewport if, for example, one or more of its vertices lie outside the edges of the viewport. This may arise, e.g., as a consequence of transformations performed on the primitive as part of the transform and lighting stage of the graphics processing.)

A consequence of the clipping process is that in order to allow the part of the primitive that remains within the viewport to be rasterised and rendered properly, new primitives may need to be generated to represent the part of the primitive that remains within the viewport after the "clipping" process.

In other words, a new primitive or primitives corresponding to exactly the section of the original primitive that was inside the viewport (the view frustum) must be generated.

The new primitive or primitives are then sent for rasterising and rendering, instead of the original primitive, thereby avoiding the need to rasterise and render a primitive that lies outside the view frustum.

Thus, the process of clipping comprises intersecting a primitive against the view frustum, and, if necessary, geometrically generating a new primitive or primitives corresponding exactly to the section of the original primitive that lay inside the view frustum.

However, the "clipping" process is fairly complex and slow, and difficult to implement.

It is desirable therefore to reduce the amount of clipping that may need to be carried out.

One known technique to try to do this is referred to as "guard band clipping". In guard band clipping, the edge planes against which primitives are tested for clipping-purposes are extended to be beyond (outside) the viewport (i.e. to be larger than the size of the display screen). This, effectively, establishes a "clipping area" top, bottom, right, and left edge planes) that is larger than the viewport (than the screen to be displayed). Then, primitives are set up for the larger "clipping" area, but the rasterisation process only rasterises fragments corresponding to the actual defined viewport (typically screen size) (i.e. for a "physical" rendering area that corresponds to the actual screen size) (by skipping all fragments that lie outside the physical screen area).

In other words, in the guard band technique, the clipping process is allowed to operate on a larger area than will in practice be displayed on the screen (by using a "guard band" to effectively extend the top, bottom, left and right edges of the viewport for clipping purposes), thereby reducing (it is intended) the number of primitives that will fall outside the clipping area at the clipping stage.

In some "guard band" arrangements, the guard band (the extension to the view port edge planes for the clipping test) is set to a finite value, such as a defined number of pixels or fragments. This will reduce the possibility of a primitive being found to extend beyond the clipping area edge planes at the clipping stage (and so needing clipping), but will not stop any primitives whose position lies outside the guard band needing clipping.

FIG. 1 illustrates this. FIG. 1 shows schematically a viewport 1 with two primitives 2, 3, and the use of a limited guard band 4 around the viewport 1. As shown in FIG. 1, if the primitive 2 extends beyond the edge of the guard band 4, clipping is still necessary in respect of the primitive 2. However, the primitive 3 may be culled completely because it lies completely outside both the guard band and the viewport).

It is also known therefore to use arrangements that effectively set the clipping area edge planes to "infinity" (i.e. to use an "infinite" guard band). This is done by setting the clipping area edge positions (x and y positions) to the appropriate maximum full floating point number-format position values that can be represented in and supported by the graphics processing system. The effect of this then is that no primitive can ever have defined for it a position that lies outside the clipping area edge planes, since the system cannot represent a number for the primitive's position that is bigger than the positions of the edge planes of the clipping area. The clipping "guard band" is therefore, effectively, infinite, since it can never be crossed by a primitive in the system in question.

However, although making the clipping area edge plane positions as large as the largest position (x, y) values that can be represented in floating point format reduces the need for clipping, another consequence of such operation is that the graphics primitive (triangle) setup operations (such as deriving edge functions for and interpolation functions across a primitive) must be done fully in floating-point number format.

The Applicants have recognised that this can lead to further problems, relating, for example, to interactions between floating-point number format roundoff errors and invariance requirements. Moreover, the Applicants have recognised that existing systems that use floating-point number representation are not in fact sufficiently robust in the presence of, for example, floating-point roundoff errors, thereby leading, for example, to problems such as pixel or fragment dropouts and/or duplication.

The Applicants believe therefore that there remains scope for improvements to graphics processing systems that use viewport guard bands to reduce the need for clipping.

According to a first aspect, there is provided a method of operating a graphics processing system when processing graphics primitives for display, in which a clipping area defining left, right, top and bottom edge planes within which a primitive must lie for processing is defined, the method comprising:

setting the respective x, y positions of the left, right, top and bottom edge planes defining the clipping area to the respective largest position values that can be represented in floating-point format in the graphics processing system;

defining the x, y positions of vertices representing primitives to be processed for display in floating-point format;

snapping the x, y positions of vertices of primitives to be processed for display to respective vertex x, y positions from a set of plural vertex x, y positions defined for the processing of primitives; and using the vertex position in the set that a given vertex is snapped to, as the x, y position of the vertex when deriving an edge function or the edge functions for an edge or the edges that includes the vertex.

According to a second aspect, there is provided an apparatus for a graphics processing system for processing graphics primitives for display, in which a clipping area defining left, right, top and bottom edge planes within which a primitive must lie for processing is defined, the apparatus comprising:

means for setting the respective x, y positions of the left, right, top and bottom edge planes defining the clipping area to the respective largest position values that can be represented in floating-point format in the graphics processing system;

means for defining the x, y positions of vertices representing primitives to be processed for display in floating-point format;

means for snapping the x, y positions of vertices of primitives to be processed for display to respective vertex x, y positions from a set of plural vertex x, y positions defined for the processing of primitives; and means for using the vertex position in the set that a given vertex is snapped to, as the x, y position of the vertex when deriving an edge function or the edge functions for an edge or the edges that include the vertex.

The clipping area left, right, top and bottom edge planes are set at the largest value (for their respective position) that can be represented in the graphics processing system in floating-point format. In other words, an "infinite" guard band arrangement is used. Similarly, vertex x, y positions are accordingly defined and processed in floating point number format.

However, the vertex x, y positions for primitives are snapped to x, y positions of a defined set of vertex x, y positions, which "snapped" positions are then used as the x, y positions of the vertices for subsequent computation of edge function(s) for the primitives (and vertices) in question. In other words, each vertex's x, y position is "snapped" to one of a set of "allowed" vertex x, y positions that have been previously defined for the graphics processing.

By snapping the vertex positions to a predefined set of allowed vertex positions, these aspects avoid in particular the possibility that where plural primitives share a common vertex, the shared vertex is in fact given slightly different screen x, y positions for each primitive due to, for example, differences in floating point rounding off when the vertex's floating-point format position is processed for each primitive.

In particular, the Applicants have recognised that if a set of primitives share an interior vertex, then each (rasterisation) sample position in the vicinity of the vertex must be assigned to only one of the primitives that share the vertex (as if a sample position when tested is found to be covered by two or more of the primitives, that will result in the primitives overlapping at that sample position when they are rendered, which would be incorrect).

To ensure that each sample position in this case is only covered by one of the primitives, the primitive's edge equations (functions) must, inter alia, when computed, represent edges that each pass exactly through the same vertex x, y position (the single, shared vertex) (in practice the primitives should share an edge between two common vertices and have the same orientations to guarantee that only one primitive is rasterised to a given sample point). The Applicants have recognised that in general this may not be the case if the edge equations for each primitive are calculated using the floating-point format vertex positions defined for each primitive, due to differences in floating-point rounding off as between each primitive and its edge equations.

The problem is solved by snapping each vertex's position to a predefined set of (allowed) vertex x, y positions, such that then when the edge equations are completed, each primitive should use the same (allowed) x, y position for the vertex, and so the edge equations for each primitive should all pass through the same vertex position.

It will be appreciated that, with respect to the clipping area that is now effectively set at infinity, the graphics processing system could still perform a clipping test against that clipping area with respect to each vertex (but, as discussed above, the vertex can never in fact fail the clipping test and so need clipping).

However, it would also, in fact, effectively be possible to skip the clipping test altogether, since it would be known that no points will ever fall outside the clipping area (the guard band) in practice.

In this case, it could be considered that there is no clipping carried out at all, and hence no clipping area defined, but the use of floating point format for vertices and the snapping of the vertices to allowed x, y positions, would still need to be carried out.

Thus, according to a third aspect, there is provided a method of operating a graphics processing system when processing graphics primitives for display, the method comprising:

defining the x, y positions of vertices representing primitives to be processed for display in floating-point format;

snapping the x, y positions of vertices of primitives to be processed for display to respective vertex x, y positions from a set of plural vertex x, y positions defined for the processing of primitives; and using the vertex position in the set that a given vertex is snapped to, as the x, y position of the vertex when deriving an edge function or the edge functions for an edge or the edges that includes the vertex.

According to a fourth aspect, there is provided an apparatus for a graphics processing system for processing graphics primitives for display, the apparatus comprising:

means for defining the x, y positions of vertices representing primitives to be processed for display in floating-point format;

means for snapping the x, y positions of vertices of primitives to be processed for display to respective vertex x, y positions from a set of plural vertex x, y positions defined for the processing of primitives; and means for using the vertex position in the set that a given vertex is snapped to, as the x, y position of the vertex when deriving an edge function or the edge functions for an edge or the edges that include the vertex.

The predefined set of "allowed" vertex x, y positions in all of the above aspects can take any suitable and desired form. It is preferably in the form of a grid of defined vertex x, y positions, most preferably a regular grid of defined vertex x, y positions.

The vertex positions in the set (e.g. grid) are preferably spaced less than a single fragment apart (i.e. less than the distance between the centre points of two adjacent fragments in the x (or y, as appropriate) direction. Thus, the grid is preferably a sub-fragment grid.

Most preferably, the vertex positions in the set (grid) (the grid points) are each separated (i.e. spaced from their nearest neighbour in the direction of the x and y axes (the grid axes)) by a distance of $2^{-n}$ fragments (i.e. $2^{-n}$ times the distance between the centres of adjacent fragments in the direction of the x or y (the grid) axis), where n is an integer greater than one.

The value of n in these arrangements may be selected as desired and may depend, for example, on the viewport-size (and/or the frame buffer size (for invariance reasons)). In general, higher values of n give better precision, but lower maximum viewport size. In a preferred embodiment n is 2 or more, preferably 4 or more. (A value of 2 or more for n (or 4 or more when 4× rotated grid multisampling is used) may be necessary for OpenGL compliance.)

Thus, in a particularly preferred embodiment, these aspects use a (predetermined) regular grid of defined vertex x, y positions in which adjacent grid points (the defined vertex positions) are separated from each other by a distance of $2^{-n}$ fragments in the X and Y directions.

The "snapping" of the floating-point format positions of a vertex to a corresponding vertex position in the set (grid) of defined vertex positions can be performed in any appropriate and suitable manner.

As will be appreciated by those skilled in the art, the aim of this process is to replace the floating point format position defined for the vertex with a vertex position (e.g. and preferably the position of a grid point) in the set of defined vertex x, y positions. Preferably the vertex position in the set (grid) of vertex positions to use for a given vertex (that the vertex is "snapped to") is the nearest vertex position (grid point) in the set to the initially defined position of the vertex that is to be replaced by the position from the set of vertex positions.

Thus, most preferably, the floating-point number format x, y position of a and preferably of each vertex is compared to the vertex x, y positions in the set of vertex positions (e.g. to the grid point positions), and replaced with the defined vertex x, y position that is closest to the floating point number format position of the vertex (e.g., and preferably, with the grid point position of the closest grid point to the floating-point number format position of the vertex).

The Applicants have found that with suitably defined vertex positions in the set of defined vertex positions, this arrangement can ensure that a shared vertex, for example, will be "snapped" to the same defined vertex position for each primitive that shares the vertex, thereby, e.g., avoiding the problem discussed above.

Moreover, the arrangement of these aspects means that if two primitives share an edge, exactly the same edge equation can be produced for both primitives, and if multiple primitive edges pass through a vertex, then each edge can be arranged to pass through exactly the same point (vertex position), notwithstanding the use of floating-point number format for vertex positions.

This is in contrast to arrangements which use floating-point number format for vertex x, y positions, which the Applicants have found are not robust in the presence of floating-point roundoff errors with respect to two primitives that share an edge, and multiple primitive edges passing through the same vertex all passing through exactly the same point (vertex position).

The vertex position in the set of defined vertex positions that a given vertex is "snapped to" is used, as discussed above, for the purpose of and when deriving the edge function for an edge or edges of the primitive (or primitives) that passes through the vertex in question.

In a preferred example embodiment, the "snapped" position of the vertex is also used when deriving any interpolation functions in relation to the vertex in question. Preferably, the "snapped" position is used when deriving any line functions in relation to the vertex. Most preferably, the "snapped" position for the vertex is used as the vertex's x, y position for all subsequent processing of the vertex.

The edge equations functions etc., can be derived in these aspects of the present invention using the "snapped" positions of the two vertices defining the edge or line, etc., in any suitable and desired manner, such as using existing edge equation derivation techniques that are known in the art.

As will be appreciated by those skilled in the art, although the clipping area is effectively set to infinity, such that no clipping should occur (and/or the clipping test is effectively omitted altogether), the graphics processing system will, preferably, when it comes to the rasterisation stage, still use a defined view frustum viewport (which in practice will be restricted to a given size, for example dependent on the value of "n" from the allowed vertex position grid-size), with rasterisation only being performed within the viewport (so that the system does not rasterise and then attempt to render all positions out to the "infinite" guard band set for the clipping area). This would be analogous to existing "guard band" clipping arrangements, in which, as discussed above, clipping may be carried out with respect to a guard band that surrounds the viewport, but rasterisation is limited to the viewport area only.

Similarly, where all the vertices primitives are found to lie within the guard band (i.e., none of the primitive extends into the viewport), then preferably the primitive is culled from further processing as and when that situation is identified. Thus, preferably, any primitives whose vertices all lie within the guard band (and not in the viewport), are culled.

Although the above arrangement addresses many issues with respect to the use of floating-point number format for vertex positions, the Applicants have recognised that it may also be desirable to take special steps in respect of primitive edges where one or more of the vertices for the edge lie outside the screen area (the viewport) to actually be rendered, but within the ("infinite") clipping area edges (i.e. lie within the "guard band" region).

The Applicants have recognised that in this case, it would be preferable to ensure that a primitive edge between an "on-screen" vertex and an "off-screen" vertex always passes exactly through the on-screen vertex regardless of how large the position coordinates for the off-screen vertex are.

Thus, in a preferred example embodiment, the edge function deriving process comprises determining which of the two vertices that form the end points of the edge is closest to the screen-space origin, determining the slope between the two vertices, and then deriving the edge function for the edge defined by the two vertices as an edge function having the determined slope and passing through the vertex that is determined to be closest to the screen-space origin.

The effect of this is that an edge function that should be guaranteed to pass through the vertex that is closest to the screen space origin (i.e. that therefore will lie closest to the centre of the visible screen) is generated and will then be used for the primitive edge in question, thereby tending to ensure that the edge passes exactly through the on-screen vertex, as discussed above.

This arrangement therefore, effectively, retains and uses, and thus prioritises, the position of the closest vertex when computing the edge function, i.e. such that the precision of that closest (and thus, usually, the most important) vertex is preferentially maintained when the edge function is derived.

The vertex that is closest to the screen-space origin can be determined in these arrangements in any suitable and desired manner. In a preferred embodiment, the two vertices that form the end points of the edge in question are ordered according to their distance from the screen-space origin in order to do this. The distance function that is used for this purpose is preferably fully commutative in order to maintain invariance with respect to the derivation of the distances. Preferably the Euclidean, Manhattan and/or Chebyshev, and preferably the Chebyshev, distance metric is used to derive the distances of the vertices from the screen-space origin.

The Applicants have found, for example, that the use of "vertex-ordering" in this manner together with snapping vertex positions to a set of allowed vertex positions facilitates, in particular, the edge functions for an edge shared by two primitives being computed identically for both primitives. This is because it can ensure that the edge function for both primitives will be derived using identical vertex positions and calculated "along" the same edge (i.e. extending from the same first vertex to the same second vertex). (Two primitives sharing an edge would typically have the "opposite" edges, $a \rightarrow b$ and $b \rightarrow a$, but if the same edge function is to be calculated for both primitives, then for both primitives the edge function must be calculated as $a \rightarrow b$ (or both as $b \rightarrow a$).) By ordering the vertices as discussed above and then deriving the edge functions accordingly, it can be ensured that the same order of vertices is used for both (all) primitives when deriving the edge functions.

Although the above arrangement has been described with particular reference to prioritising the position of the closest vertex to the screen-space origin, other criteria for selecting the vertex to use preferentially in the edge equation could be used, if desired. For example, it could be the case that one of the x or y positions will have the strongest influence on the edge equation, and so it may be preferred to preferentially preserve the x-values (X-major) or y-values (Y-major) of the vertices, positions.

In general, if one wishes to ensure consistent edge function derivation (i.e. such that the same edge function is derived for different primitives), then the selection or prioritisation of vertices to be used for the same edge functions should be consistent (but the particular criteria used for prioritising the vertices in any given system may differ, depending upon the intended aim or desire for the overall graphics processing).

The Applicants believe that these arrangements for deriving edge equations may be new and advantageous in their own right, and not just where vertex positions are also snapped to a set of predefined vertex positions as discussed above, since, for example, they can help to ensure that edge equations pass through desired vertices anyway.

Thus, according to a fifth aspect, there is provided a method of deriving an edge function representing an edge extending between two vertices defined in a graphics processing system, the method comprising:

determining the slope of the edge extending between the two vertices;

selecting one of the two vertices; and deriving the edge function as an edge having the determined slope and passing through the selected vertex.

According to a sixth aspect, there is provided an apparatus for deriving an edge function representing an edge extending between two vertices defined in a graphics processing system, the apparatus comprising:

means for determining the slope of the edge extending between the two vertices;

means for selecting one of the two vertices; and means for deriving the edge function as an edge having the determined slope and passing through the selected vertex.

As will be appreciated by those skilled in the art, these aspects can and preferably do include any one or more or all of the preferred and optional features described herein, as appropriate. Thus, for example, the selected vertex is preferably the vertex that is closest to the screen-space origin.

Similarly, in these aspects, the vertex positions are preferably initially defined in floating-point number format, and, preferably, the position of each vertex is snapped to a set or grid of defined vertex x, y positions, with the "snapped" positions of the vertices then being used for deriving the edge function.

Equally, the arrangement is preferably one in which a clipping area that extends beyond the visible screen area is used (i.e. a guard band arrangement), and preferably, in which the outer edge plane positions of the clipping area are set as the respective largest x, y values in floating-point format that can be represented.

Thus, preferably, the method and system of these aspects are applied to a graphics processing system in which a clipping area having top, bottom, left and right edge planes set at the respective largest x, y position values that can be represented in floating point format for the graphics processing system is defined, and in which vertex positions are initially defined and processed in floating point format.

The above embodiments and aspects address the issue of avoiding clipping in respect of the top, bottom, left and right edges of the clipping area used in graphics processing.

However, as discussed above, the view frustum also includes "front" and "back", depth planes, defined as the (depth) near plane and the (depth) far plane. FIG. 7 illustrates this and shows schematically a far plane 40 and a near plane 41 relative to a viewing position 42. (FIG. 7 also shows the eye-plane 43. This will be discussed further below.)

As is known in the art, in graphics processing a depth or "Z" value is defined or computed for each vertex, fragment, etc., representing its depth (its distance in the Z-axis direction) from the view point. In practice, the Z (depth) value is derived such that a value Z=0 represents points in the near depth plane (the front plane of the view frustum), and a value Z=1 represents points in the far depth plane (the rear or back plane of the view frustum). Thus, locations in the view frustum correspond to Z-values in the range 0 to 1 ([0,1]).

However, primitives can be defined (or be transformed to have) vertices that have Z-values falling outside the view frustum [0,1] range. In this case, a part of the primitive will extend beyond (stick out through) the near or far depth plane, accordingly.

Such extending of primitives beyond the near and far depth planes of the view frustum can also lead to rendering problems if left uncorrected, since it can, for example, lead to a primitive being treated as an "outer" primitive rather than an "inner" primitive, which can lead to odd and undesirable effects after rendering, such as primitive "wrapping", etc.

Thus, again, it has previously been the practice to "clip" primitives that extend beyond the near or far depth planes, so as to avoid this problem arising.

While it would still be possible to perform near and far plane clipping in the present invention, the Applicants have recognised that it would be preferable not to have to do this, for the reasons discussed above.

Thus, a preferred example embodiment sets the depth values of the near and far planes for the purposes of a clipping test to greater than the range 0 to 1, and preferably to the respective maximum floating point number format depth (Z) values that the graphics processing system can use and support (and in this case using a full floating-point number format depth (Z) value for vertices of primitives to be rendered).

This has the effect that vertices can have depth (Z) values beyond the near and far viewport planes, e.g., up to the maximum possible values that can be represented in the system, i.e., such that, in effect, a guard band is applied to the near and far depth planes for the purposes of "clipping", in a similar manner to the guard band for the viewport edges discussed above. Where this guard band is set to the maximum floating point values (to "infinity"), then this will again mean that, in effect, no primitive can have a depth (Z) value (for one of its vertices) that extends beyond the near and far depth planes at the "clipping" stage, such that there should in that case never be any need to "clip" primitives in respect of the near and far depth planes (since vertices could in that case have depth values extending beyond 0 and 1 and out to the maximum floating point number depth values that can be represented).

This arrangement accordingly reduces or avoids the need for any clipping in respect of the rear and far depth planes.

It is believed that such arrangements may be new and advantageous in their own right, since they may, for example, allow clipping in respect of the near and far depth planes to be avoided, whether or not steps are also taken to avoid clipping at the viewport edges, for example.

Thus, according to a seventh aspect, there is provided a method of processing graphics primitives for display, in a system in which view frustum near and far depth planes having a defined range of depth values between them are defined, the method comprising:

setting the depth values of the near and far planes for the purposes of a clipping test to be respectively outside the view frustum near and far depth planes; and performing a clipping test in respect of Z values for vertices against the near and far planes defined for the clipping test.

According to an eighth aspect, there is provided an apparatus for processing graphics primitives for display, in a graphics processing system in which view frustum near and far depth planes having a defined range of depth values between them are defined, the apparatus comprising:

means for setting the depth values of the near and far planes for the purposes of a clipping test to be respectively outside the view frustum near and far depth planes; and means for performing a clipping test in respect of Z values for vertices against the near and far planes defined for the clipping test.

As will be appreciated by those skilled in the art, these aspects can and preferably do include any one or more or all of the preferred and optional features of the invention described herein. Thus, for example, preferably the depth values of the near and far planes for the purposes of a clipping test are set to the respective maximum floating point number format depth (Z) values that the graphics processing system can use and support, and/or a full floating-point number format depth (Z) value can be and is used for vertices of primitives to be rendered.

Thus, according to a ninth aspect, there is provided a method of processing graphics primitives for display, in a system in which view frustum near and far depth planes having a defined range of depth values between them are defined, the method comprising:

setting the depth values of the near and far planes for the purposes of a clipping test to the respective maximum floating point number format depth (Z) values that the graphics processing system can use and support; and using a full floating-point number format depth (Z) value for vertices of primitives to be rendered.

According to a tenth aspect, there is provided an apparatus for processing graphics primitives for display, in a graphics processing system in which view frustum near and far depth planes having a defined range of depth values between them are defined, the apparatus comprising:

means for setting the depth values of the near and far planes for the purposes of a clipping test to the respective maximum floating point number format depth (Z) values that the graphics processing system can use and support; and means for using a full floating-point number format depth (Z) value for vertices of primitives to be rendered.

Again, as will be appreciated by those skilled in the art, these aspects can and preferably do include any one or more or all of the preferred and optional features described.

It will be appreciated that in the above arrangements because vertices and primitives will not be clipped to a range of depth values falling between zero to one, it would be possible that fragments having depth values that lie outside the zero to one range would, in effect, be generated for rendering. In practice it would normally be desirable for the displayed view frustum to still be limited in terms of its near and far planes to depth values within the range zero to one, and so although the arrangement of these aspects may generate fragments having depth values falling outside that range to be sent for rendering, it is preferred that those fragments are not stored or retained for display purposes, and, most preferably, do not affect fragments that will or could be retained or stored for display.

In a particularly preferred embodiment therefore, notwithstanding the fact that the front and near depth planes are set to larger values for the purposes of any clipping test, it is preferred also to subsequently discard any fragments having depth values falling outside other defined near and far depth planes (e.g., and preferably, defined for the view frustum), and most preferably falling outside near and far depth planes having a range of depth values defined between the near and far depth planes of zero to one.

In these arrangements, fragments for rendering have depth values that fall outside the permitted (e.g. 0 to 1) range can be identified and discarded in any suitable and desired manner. For example, they could be discarded by performing a graphics depth (Z) test on them (by comprising the fragment's depth values with the permitted depth value range), for example as part of the depth test that is normally carried out at the end of a graphics rendering pipeline.

In one preferred example embodiment, the fragments are discarded by carrying out a so-called "early Z-test" for this purpose, e.g. a Z (depth)-test that takes place as part of the rasterisation process, or after rasterisation but before, or at the beginning of, the rendering process.

In another preferred embodiment for discarding the fragments falling outside the defined "rendering" near and far planes, the fragments are "discarded" by not generating them for rendering at the rasterisation stage. This may be done, e.g., and preferably, by defining edges representing the near and far planes, depth positions (e.g., and, where appropriate, an edge (plane) for Z=0, and an edge (plane) for Z=1), e.g., and preferably, at the primitive setup stage, and then performing an edge test in respect of these edges (like for any other edge function) (e.g., and preferably, as part of the rasterisation process when the other edges for a primitive will be tested), to thereby effectively "discard" (not generate for rendering) all fragments falling outside the defined "depth" edges. This would then, effectively, test the near and far depth planes as part of the rasterisation process.

It can be seen that in the above preferred arrangements, Z-values for vertices may, in effect, be calculated with full precision, but fragments are then discarded (by not being produced for rendering or by being culled during rendering) if they fall outside the 0 to 1 depth value range.

The above arrangements help to address the question of clipping with respect to the top, bottom, left, right, front and back (near and far) planes of the view frustum. However, there is a further plane that can trigger clipping in a graphics processing system, the so-called "eye-plane".

The "eye-plane", as is known in the art, is a plane that is parallel to the Z (depth) near and far planes, and that conceptually passes through the position of the eye or camera. Distances of objects, vertices, fragments, etc., from the eye-plane are expressed in terms of a W-value, which is, in effect, a "depth value" relative to the eye-plane (the distance from the eye-plane to the point in question). A positive value of W indicates that the vertex lies behind (beyond) the eye-plane, whereas a negative value of W indicates that the vertex is in front of the eye-plane.

The eye-plane distance value "W" is measured along the same axis as Z-values (the Z-axis), but may vary at a different rate along that axis to the rate of change of Z-values along the Z-axis.

Typically, for each vertex, a W-value is computed or defined along with a Z-value. The Z-value is used, as discussed above, to compare the depths of vertices, etc., in the scene. The W-value is normally used for perspective correction.

The eye-plane is usually set to have a value W=0. If a primitive could in part lie in front of the eye plane (in effect, extend or lie behind the viewer), i.e. have a value W<0, that can again cause a problem with the primitive's processing, for example in terms of the derivation of edge and interpolation, etc., functions for the primitive. It is therefore usual to clip primitives that may extend or lie in front of the eye-plane (that could have values of W<0).

It would be desirable therefore to also be able to reduce or avoid the need for clipping in respect of the eye-plane (in respect of eye-plane intersections).

Thus, in a preferred example embodiment, after the edge functions representing edges extending between respective vertices of a primitive have been determined, for each of the vertices of the primitive that has a negative value of W (the eye-plane distance), (changing from positive to negative or vice-versa) the signs of the opposite edge function are flipped (i.e. the edge function defining the edge between the vertices opposite to the vertex in question).

If an odd number of the vertices of the primitive have negative values of W, flipping (i.e. changing from clockwise to counter-clockwise or vice-versa) the winding of the primitive may be done for the purposes of determining whether the polygon is front-facing or back-facing.

In this example embodiment, the W value of each vertex of a primitive is considered, and for each vertex having a negative value of W (i.e. indicating that the vertex lies in front of the eye-plane), the signs of the opposite edge equation are flipped.

This corrects for the problem that the x/y components of the vertex will "wrap around" the coordinate system when divided by a negative W during the viewport mapping process (and so avoids the need to instead try to avoid any situation where coordinate system "wrap around" could occur).

Furthermore, the winding of primitive for the purposes of determining whether the primitive is front- or back-facing is flipped if an odd number of the vertices have negative values of W. This latter step ensures that the primitive's facing direction is maintained correct after the signs of the edge function (s) are flipped, and will have the effect that if an odd number of the vertices of the primitive have negative values of W, the primitive's winding is flipped from its original winding.

These arrangements have been found by the Applicants to allow for the satisfactory handling of primitives that may intersect the eye-plane in a graphics processing system, without the need to perform any clipping in respect of eye-plane intersections.

It is again believed that these arrangement may be new and advantageous in their own right, since they may, for example, allow the need for clipping in respect of eye-plane intersections to be avoided, whether or not other clipping in respect of the view frustum is also to be performed.

Thus, according to an eleventh aspect, there is provided a method of processing a graphics primitive in a graphics processing system, in which the graphics primitive is defined by a plurality of vertices, and each vertex has associated with it a W-value representing the distance of the vertex from the eye-plane, the method comprising:

deriving the edge functions for each edge of the primitive;

for each of the vertices of the primitive that has a negative value of W, flipping the signs of the edge function derived for the opposing edge of primitive; and if an odd number of the vertices of the primitive have negative values of W, flipping the winding of the primitive for the purpose of determining whether the primitive is front-facing or back-facing.

According to a twelfth aspect, there is provided an apparatus for processing a graphics primitive in a graphics processing system, in which the graphics primitive is defined by a plurality of vertices, and each vertex has associated with it a W-value representing the distance of the vertex from the eye-plane, the apparatus comprising:

means for deriving the edge function for each edge of the primitive;

means for, for each of the vertices of the primitive that has a negative value of W, flipping the signs of the edge function derived for the opposing edge of primitive; and means for, if an odd number of the vertices of the primitive have negative values of W, flipping the winding of the primitive for the purpose of determining whether the primitive is front-facing or back-facing.

As will be appreciated by those skilled in the art, these aspects and embodiments can include any one or more or all of the preferred and optional features of the present invention described herein, as appropriate. Thus, for example, preferably the above arrangements to reduce or avoid clipping in respect of other view frustum planes are used as well.

In a preferred example embodiment of these aspects and embodiments, the signs of the edge equations and of the primitive winding are flipped in respect of each vertex that has a negative value of W in turn.

Thus, in a preferred example embodiment, after the edge equations representing edges extending between respective vertices of a primitive have been determined, if any vertex has a negative value of W (the eye-plane distance), (changing from positive to negative or vice-versa) the signs of the opposite edge equation (i.e. the edge equation between the vertices opposite to the vertices in question) may be flipped, and (i.e. changing from clockwise to counter-clockwise or vice-versa) the winding of the primitive may be flipped for the purposes of determining whether the polygon is front-facing or back-facing, and this process maybe repeated for each vertex of the primitive that has a negative value of W.

It will be appreciated from the above that in these arrangements and aspects of the edge functions generated for a primitive are, in effect, modified in dependence on the sign of the W value for each vertex of the primitive. Thus, in the edge functions generated for a primitive may be modified in dependence on the sign of the W value for a or each vertex of the primitive:

Similarly, according to a thirteenth aspect, there is provided a method of processing a graphics primitive in a graphics processing system, in which the graphics primitive is defined by a plurality of vertices, and each vertex has associated with it a W-value representing the distance of the vertex from the eye-plane, the method comprising:

deriving the edge functions for each edge of the primitive; and modifying the edge functions generated for the primitive in dependence on the sign of the W value for each vertex of the primitive.

According to a fourteenth aspect, there is provided an apparatus for processing a graphics primitive in a graphics processing system, in which the graphics primitive is defined by a plurality of vertices, and each vertex has associated with it a W-value representing the distance of the vertex from the eye-plane, the apparatus comprising:

means for deriving the edge function for each edge of the primitive; and means for modifying the edge functions generated for the primitive in dependence on the sign of the W value for each vertex of the primitive.

As will be appreciated by those skilled in the art, these aspects and embodiments can include any one or more or all of the preferred and optional features described, as appropriate. Thus, for example, the modifying of the edge functions preferably comprises flipping the sign of the opposite edge equation in respect of each vertex that has a negative value of W.

In a preferred example embodiment, a test is made to see if all the vertices of a primitive have a negative value of W, and if they do, the primitive is culled (discarded) from further processing (since if all the vertices have W<0, then the primitive will be completely in front of the eye plane and so will not be seen at all).

In the above aspects and embodiments of the invention relating to testing for negative values of W, it is preferably the sign-bit only that is considered when determining whether the value of W is negative or not. Similarly, a value W=−0 is considered to be negative (and W=+0 is considered to be positive), accordingly.

The above aspects and embodiments relating to the treatment of eye-plane clipping are particularly applicable to primitives having odd numbers of vertices. Thus, the above aspects and embodiments may apply to primitives having odd numbers of vertices, and most preferably to primitives in the form of triangles.

In a preferred example embodiment, similar techniques are applied and used in respect of interpolation functions for the primitive as well. However, in this case, the signs of the interpolation function may not need to be flipped directly (because perspective correct interpolation requires the adjoint matrix calculated in primitive setup to be multiplied with the W-value, which already flips the sign if W is negative).

It will be appreciated from the above that the above techniques for reducing or avoiding the need for clipping may be used when processing graphics primitives.

Thus, according to a further aspect, there is provided a method of operating a graphics processing system when processing graphics primitives for display, in which a viewport defining left, right, top and bottom edge planes within which a primitive must lie for rendering is defined, view frustum near and far depth planes having a defined range of depth values between them are defined, and in which each graphics primitive is defined by a plurality of vertices, and each vertex has associated with it a W-value representing the distance of the vertex from the eye-plane, the method comprising:

Thus, according to a further aspect of the present invention, there is provided a method of operating a graphics processing system when processing graphics primitives for display, in which a viewport defining left, right, top and bottom edge planes within which a primitive must lie for rendering is defined, view frustum near and far depth planes having a defined range of depth values between them are defined, and in which each graphics primitive is defined by a plurality of vertices, and each vertex has associated with it a W-value representing the distance of the vertex from the eye-plane, the method comprising:

setting the respective x, y positions of the left, right, top and bottom edge planes defining an allowed clipping area to the respective largest position values that can be represented in floating-point format in the graphics processing system;

defining the x, y positions of vertices representing primitives to be processed for display in floating-point format;

snapping the x, y positions of vertices of primitives to be processed for display to respective vertex x, y positions from a set of plural vertex x, y positions defined for the processing of primitives;

deriving edge functions representing edges extending between respective pairs of vertices by:

using as the x, y positions of the vertices when deriving the edge function, the vertex positions in the set that the vertices have been snapped to; and by determining the slope of the edge extending between the two vertices;

selecting one of the two vertices; and deriving the edge function as an edge having the determined slope and passing through the selected vertex;

the method further comprising:

setting the depth values of the near and far planes for the purposes of a clipping test to the respective maximum floating point number format depth (Z) values that the graphics processing system can use and support;

using a full floating-point number format depth (Z) value for vertices of primitives to be rendered; and, after the edge functions for each edge of a primitive have been derived;

for each of the vertices of the primitive that has a negative value of W flipping the signs of the edge function derived for the opposing edge of primitive; and if an odd number of the vertices of the primitive have negative values of W, flipping the winding of the primitive for the purpose of determining whether the primitive is front-facing or back-facing.

According to another aspect, there is provided an apparatus for processing graphics primitives for display, in which a viewport defining left, right, top and bottom edge planes within which a primitive must lie for rendering is defined, view frustum near and far depth planes having a defined range of depth values between them are defined, and in which each graphics primitive is defined by a plurality of vertices, and each vertex has associated with it a W-value representing the distance of the vertex from the eye-plane, the apparatus comprising:

means for setting the respective x, y positions of the left, right, top and bottom edge planes defining an allowed clipping area to the respective largest position values that can be represented in floating-point format in the graphics processing system;

means for defining the x, y positions of vertices representing primitives to be processed for display in floating-point format;

means for snapping the x, y positions of vertices of primitives to be processed for display to respective vertex x, y positions from a set of plural vertex x, y positions defined for the processing of primitives;

means for deriving edge functions representing edges extending between respective pairs of vertices comprising:

means for using as the x, y positions of the vertices when deriving the edge function, the vertex positions in the set that the vertices have been snapped to; and means for determining the slope of the edge extending between the two vertices;

means for selecting one of the two vertices; and means for deriving the edge function as an edge having the determined slope and passing through the selected vertex;

the apparatus further comprising:

means for setting the depth values of the near and far planes for the purposes of a clipping test to the respective maximum floating point number format depth (Z) values that the graphics processing system can use and support;

means for using a full floating-point number format depth (Z) value for vertices of primitives to be rendered; and means for, after the edge functions for each edge of a primitive have been derived:

for each of the vertices of the primitive that has a negative value of W, flipping the signs of the edge function derived for the opposing edge of primitive; and for, if an odd number of the vertices of the primitive have negative values of W, flipping the winding of the primitive for the purpose of determining whether the primitive is front-facing or back-facing.

As will be appreciated by those skilled in the art, these aspects can include any one or more or all of the preferred and optional features described, as appropriate.

Although described in part with reference to the processing of a single graphics primitive, as will be appreciated by those skilled in the art, an image to be displayed will typically be made up of plural primitives. So in practice the techniques will be repeated for each primitive making up the scene, as appropriate (i.e. repeated for plural primitives).

The primitives that are processed in the manner described may be any suitable and desired such primitives. They are preferably in the form of simple polygons, as is known in the art. In a preferred embodiment the primitives are triangles.

In a preferred example embodiment, the various functions are carried out on a single graphics processing platform that generates and outputs the data that is written to a frame buffer for a display device. In a preferred example embodiment, the various functions, elements, etc. comprise and/or are carried out by appropriate functional units, processors and/or processing logic that are operable to perform the various steps and functions, etc.

Any form or configuration of graphics processor may be used, such as graphics processor having a "pipelined" arrangement. In a preferred example embodiment, a hardware graphics pipeline may be used.

The technology described in this application is applicable to all forms of graphics processing and rendering, such as immediate mode rendering, deferred mode rendering, tile-based rendering, etc., although it is particularly applicable to graphics renderers that use deferred mode rendering and in particular to tile-based renderers.

As will be appreciated from the above, the technology described in this application is particularly, although not exclusively, applicable to 3D graphics processors and processing devices, and accordingly extends to a 3D graphics processor and a 3D graphics processing platform including the apparatus of or operated in accordance with any one or more of the aspects described herein. Subject to any hardware necessary to carry out the specific functions discussed above, such a 3D graphics processor can otherwise include any one or more or all of the usual functional units, etc., that 3D graphics processors include.

It will also be appreciated by those skilled in the art that the described aspects and embodiments can include, as appropriate, any one or more or all of the preferred and optional features described herein.

The methods may be implemented at least partially using software, e.g., computer programs executed by a computer. It will thus be seen that a further aspect provides computer software specifically adapted to carry out the methods herein described when installed on data processing means, a computer program element comprising computer software code portions for performing the methods herein described when the program element is run on data processing means, and a computer program comprising code means adapted to perform all the steps of a method or of the methods herein described when the program is run on a data processing system. The data processing system may be a microprocessor system, a programmable FPGA (Field programmable gate array), etc.

The technology described in this application also extends to a computer software storage medium comprising such software which when used to operate a graphics processor, renderer or microprocessor system comprising data processing means causes in conjunction with said data processing means said processor, renderer or system to carry out the steps of the methods described. Such a computer software carrier could be a physical storage medium such as a ROM chip, CD ROM or disk.

It will further be appreciated that not all steps of the methods described need be carried out by computer software.

The technology described in this application may accordingly suitably be embodied as a computer program product for use with a computer system. Such an implementation may comprise a series of computer readable instructions fixed on a tangible medium, such as a computer readable medium, for example, diskette, CD-ROM, ROM, or hard disk.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical. It is contemplated that such a computer program product may be distributed as a removable medium with accompanying printed or electronic documentation, for example, shrink-wrapped software, pre-loaded with a computer system, for example, on a system ROM or fixed disk, or distributed from a server or electronic bulletin board over a network, for example, the Internet or World Wide Web.

A number of non-limiting example embodiments will be described by way of example only and with reference to the accompanying drawings, in which.

A non-limiting, example embodiment will now be described in the context of the processing of 3D graphics for display.

FIG. 2 shows schematically a graphics processing pipeline.

Figure 1:
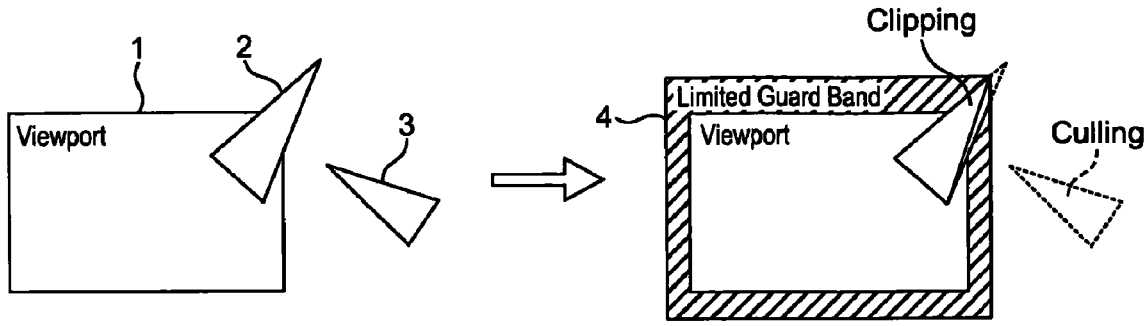
FIG. 1 shows schematically a guard band clipping arrangement.
Figure 2A:
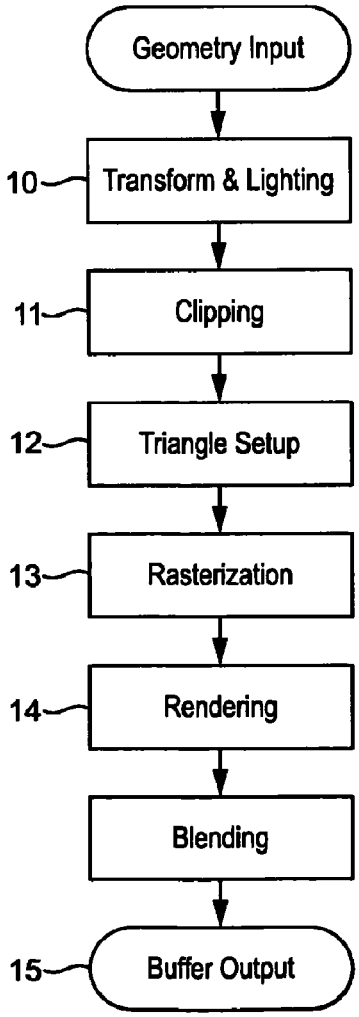
FIG. 2A shows schematically a graphics processing pipelines and FIG. 2B shows schematically a graphics processing pipeline.
Figure 2B:
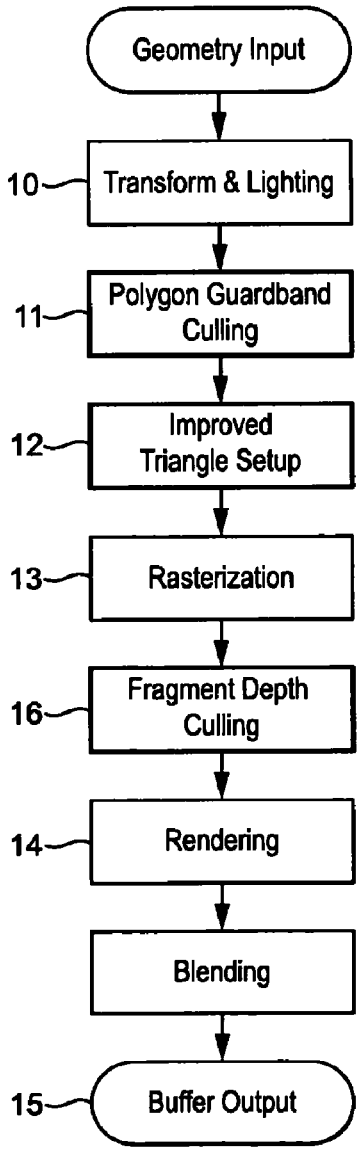

FIG. 2A shows a "standard" graphics processing pipeline and FIG. 2B shows the pipeline including the additional arrangements.

As shown in FIGS. 2A and 2B, the graphics processing pipeline includes a transform and lighting stage 10 that receives primitives and applies transformations and lighting effects to the primitives (to the vertices that define the primitives), as is known in the art.

There is then a clipping/guard band culling stage 11, and a triangle set-up stage 12. The triangle set-up stage 12 inter alia, derives edge functions defining the edges of primitives from the vertices defined for the primitives, and also line and interpolation functions for deriving how data, such as colour values, will vary across a primitive. These functions are derived, as is known in the art, from data defined for the vertices that define the primitive in question.

There is then a rasterisation stage 13 where, as is known in the art, the primitives are rasterised into fragments which will then be rendered. The pipeline then includes a rendering stage 14 which receives the fragments from the rasteriser, and applies the various rendering operations, such as adding textures, fogging, blending, etc., to each fragment from the rasteriser in turn. Finally, the rendered fragments are output to appropriate buffers 15, such as tile buffers, for then sending to a frame buffer for the display which is being used to display the graphics.

In the present example embodiment, various steps are taken so as to reduce or eliminate the need for any clipping of primitives after the transformation and lighting stage of the graphics processing pipeline. These include, as shown in FIG. 2B, a modified primitive (polygon) guard band culling stage 11, an improved triangle set-up stage 12, and a fragment depth culling stage 16. Preferred example embodiments of these techniques are described below.

Figure 3:
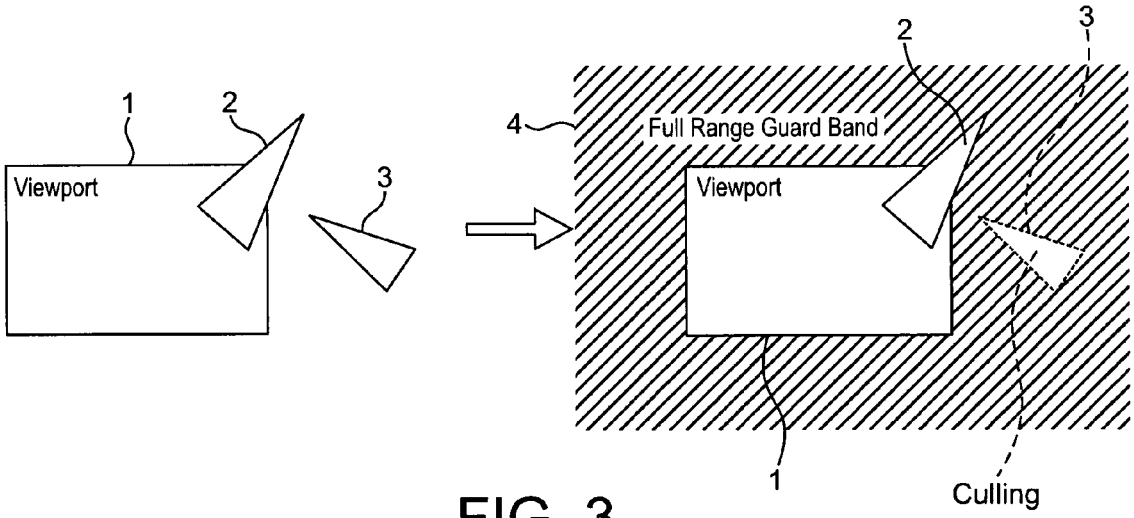
FIG. 3 shows schematically the top, left, bottom and right edge plane clipping arrangement.

The first such technique used in the present embodiment is to have a guard band for the purposes of left, right top and bottom clipping test planes that extends to the maximum respective floating point number values that can be represented in the graphics processing system (i.e., the use of an "infinite" guard band). FIG. 3 illustrates this.

As shown in FIG. 3, the guard band top, bottom, left and right edge planes are defined as being at the appropriate X and Y screen space distance values that are the largest values that can be represented in the graphics processing system in a floating-point number format. This effectively means that no vertices can ever fall outside the clipping guard band 4 top, bottom, left and right edge planes, since those planes are set at the number and representation limit of the graphics processing system. There will accordingly never be any need for clipping in respect of the guard band edge planes.

Also as shown in FIG. 3, any primitive, such as the primitive 3, that lies solely within the guard band region 4 is culled.

One consequence of this arrangement is that the triangle set-up processing, and in particular the derivation of the edge functions and interpolation functions for a primitive to be rendered must be done fully in floating-point number format.

In order to avoid this in itself causing problems in the rendering process, for example in relation to interactions between floating-point roundoff errors and invariance requirements, in the present embodiment the triangle set up processing is modified (improved).

Firstly, all vertices are snapped to a regular grid of defined and allowed vertex x, y positions, in which the grid points are separated by $2^{-n}$ fragments for some positive integer value of n (in the present embodiment n is 2 or 4). In other words, the position of any vertex is replaced by the position of the closest grid point to that vertex.

This is done by calculating the position of the vertex in full floating-point format, but then finding the nearest grid point to that vertex position, and then replacing the vertex's initially defined floating-point position with the x, y position of the identified nearest grid point (i.e. snapping the vertice's x, y position to the x, y position of the nearest grid point to the vertex). This means that, in effect, there is a predefined grid of allowed vertex x, y positions, which each and every vertex sent for rendering is snapped to appropriately.

Figure 5:
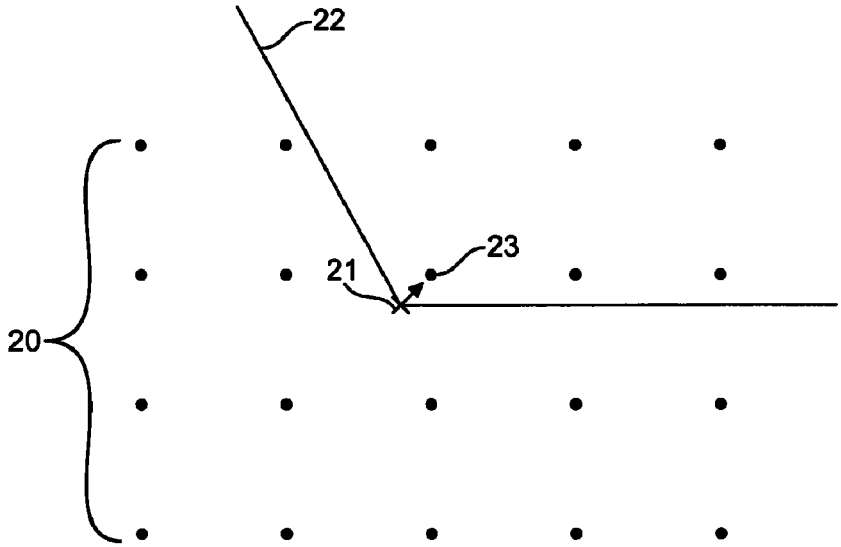
FIG. 5 shows schematically the vertex-snapping process.

FIG. 5 illustrates this. As shown in FIG. 5 there is a regular grid 20 of allowed vertex x, y positions, and for a given vertex 21 of a primitive 22, the position of the vertex that is used for subsequent processing of the vertex 21 is taken to be the position of the closest grid point 23 to the position 21 of the vertex in full floating point number format. The grid position 23 to which vertex 21 is snapped to is then used as the position of the vertex for all subsequent processing in relation to the vertex 21.

This ensures that, notwithstanding any differences in floating-point roundoff, etc., any vertex shared between a plurality of primitives should always be snapped to the same grid point x, y position, such that, accordingly, any edge equations derived in respect of such a shared vertex will be consistent across the plural different primitives that share the vertex.

Secondly, when the edge and interpolation functions for a primitive are being derived, in the present embodiment the two vertices that form the end points of the edge or interpolation function are ordered according to their x, y distance from the screen space origin, and the relevant slope between the two vertices is determined (e.g. in terms of the rate of change of position for an edge function, or the rate of change of the appropriate data value for an interpolation function).

The edge equation or interpolation function to use for the edge or function is then generated by taking an edge or interpolation function, respectively, of the requisite determined slope that passes through the vertex that was determined to be closest to the origin.

The effect of this arrangement is that when determining the edge and interpolation functions, the x, y position or positions of the closest vertex to the screen space origin is preserved. This should therefore help to ensure suitable consistency and invariance in the derivation of the edge functions and interpolation functions, since the closest vertex to the screen space origin would normally be expected to be the most important vertex whose data and position and precision should be preserved.

Figure 4A:
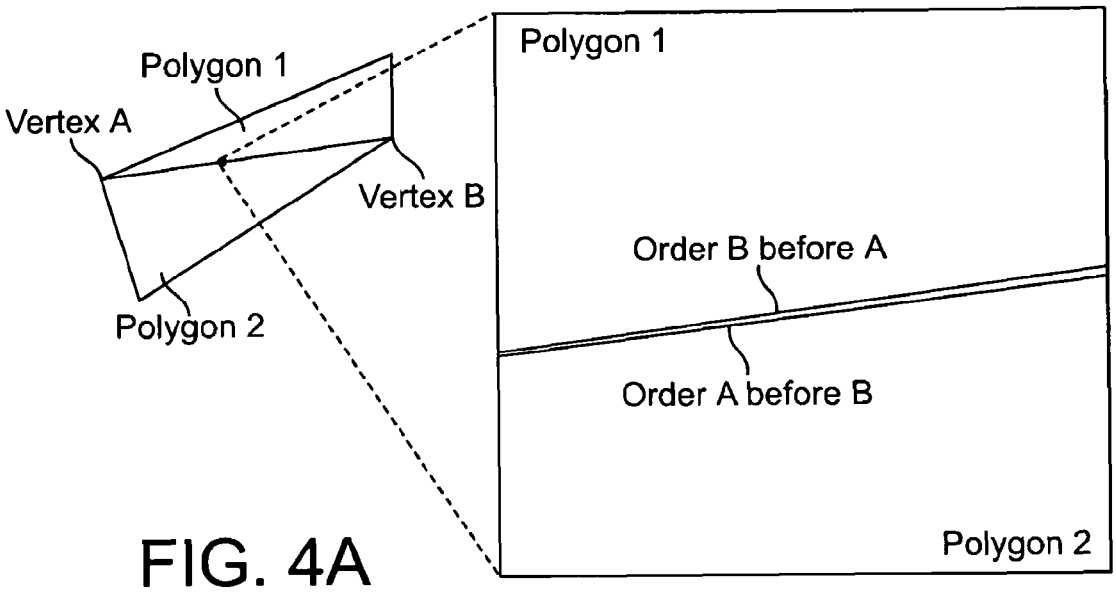
FIGS. 4A and 4B illustrate schematically the edge function derivation process.

FIG. 4 illustrates this. FIG. 4A shows the situation where the edge extending between vertex a and vertex b is derived separately for a first polygon, polygon 1 and a second polygon, polygon 2, without using the technique of the present invention. In this case, the edge extending between the vertices a and b for the polygon 1 will typically be defined as extending in a direction b to a, whereas for polygon 2, the edge will be derived as extending from a to b. This can have the effect, particularly when fully floating point numbers are used, that, as shown in FIG. 4A, the edge function derived in respect of polygon 1 and the edge function derived in respect of polygon 2 may not exactly coincide.

Figure 4B:
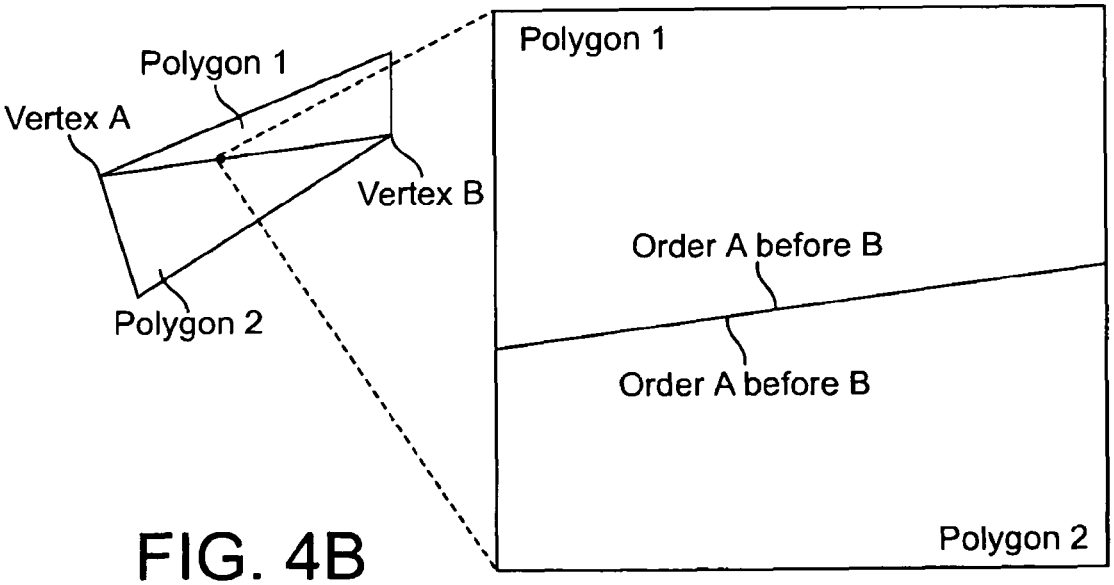

FIG. 4B illustrates the same operation but using technology described in this application. In this case, it is assumed that the vertex a is the closest to the screen space origin, and so, notwithstanding the way in which the edge extending between the vertex a and the vertex b may be defined in respect of each polygon, polygon 1 and polygon 2, when using the technique of the present invention, the edge function for polygon 1 is derived as extending from a to b, and the corresponding edge function for polygon 2 is also derived as extending from vertex a to vertex b. This has the effect that, as shown in FIG. 4B, the edge function as derived for polygon 1 will coincide exactly with the edge function as derived for polygon 2.

In the present embodiment, the order of the vertices according to the distance from the screen space origin is determined using the Chebyshev distance metric. However other distance metrics that are fully commutative, such as Euclidean or Manhattan distance metrics could be used instead.

The above arrangements have been found to reduce or avoid the need for clipping in respect of top, left, bottom and right edge planes.

It should further be noted here, that although, as discussed above, there is no culling in respect of top, bottom and right edge planes, at the rasterisation stage 13 of the graphics processing, it is only the area corresponding to the viewport 1 that is rasterised into fragments for rendering (i.e., such that it is not attempted to render the full area of the guard band).

In order to reduce or avoid the need for clipping in respect of the depth near and far planes of the view frustum, in the present embodiment, rather than clipping primitives having vertices that are found to have Z (depth) values outside the range of zero to one, instead vertices are allowed to have full floating-point number format Z values and those values are used when the primitive is rasterised into fragments. In other words, no clipping is performed in respect of the Z values, but instead all the Z (depth) calculations for vertices and fragments are carried out using full floating-point Z values.

This effectively allows an "infinite" guard band in respect of the near and far depth planes as well.

Then, in the present embodiment, an early Z value test is performed on the rasterised fragments, so as to discard any fragments having a Z value falling outside the range zero to one. This is performed by the fragment depth culling stage 16 shown in FIG. 2B.

This, in effect, ensures that any fragments falling outside the desired view frustum depth near and far planes (i.e. outside the range of Z zero to one) are discarded from rendering, but without the need to perform clipping to discard such fragments.

Other arrangements with regard to discarding fragments having Z values that fall outside the permitted range of zero to one could be used. For example, a depth test in respect of the values could be performed at the end of the rendering process, instead of at the beginning of the rendering process. However, that would have the disadvantage that fragments that ultimately will be discarded, would still need to be rendered.

Another alternative would be to define as part of the triangle set-up process, edge functions for the Z=0 and Z=1 edges, which edges would then be included in the rasterisation process, such that, in effect, again no fragments having depth values falling outside the range of zero to one would be produced by the rasteriser for rendering.

Finally, in the present embodiment, in respect of the eye plane, the present embodiment is configured such that after all the edge equations and interpolation functions have been derived for a given primitive in the triangle set-up stage 12, a final test is carried out to determine if any of the vertices for the primitive in question have a negative value of W.

For each vertex that has a negative value of W, the signs of the opposite edge equation and interpolation function or functions (i.e. the edge equation and interpolation functions between the two opposing vertices, e.g., in the case of a primitive that is in the form of a triangle, between the other two vertices in the triangle) are flipped (i.e. from positive to negative or vice-versa), and the primitive's winding for the purpose of determining whether the primitive is front or back facing is flipped (i.e. changed from clockwise to counter-clockwise or vice-versa). The effect of this latter stage is that if an odd number of vertices have negative values of W, then overall, the primitive's winding will be flipped.

Figure 6:
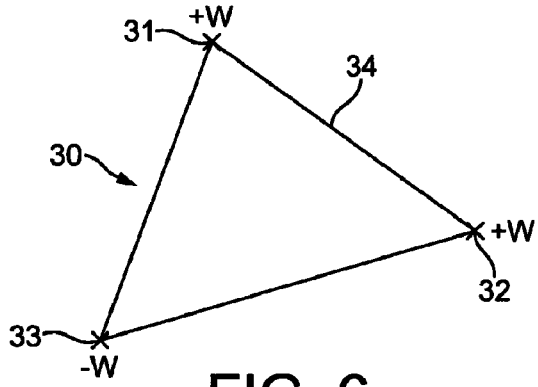
FIG. 6 shows schematically the treatment of eye plane considerations.
Figure 7:
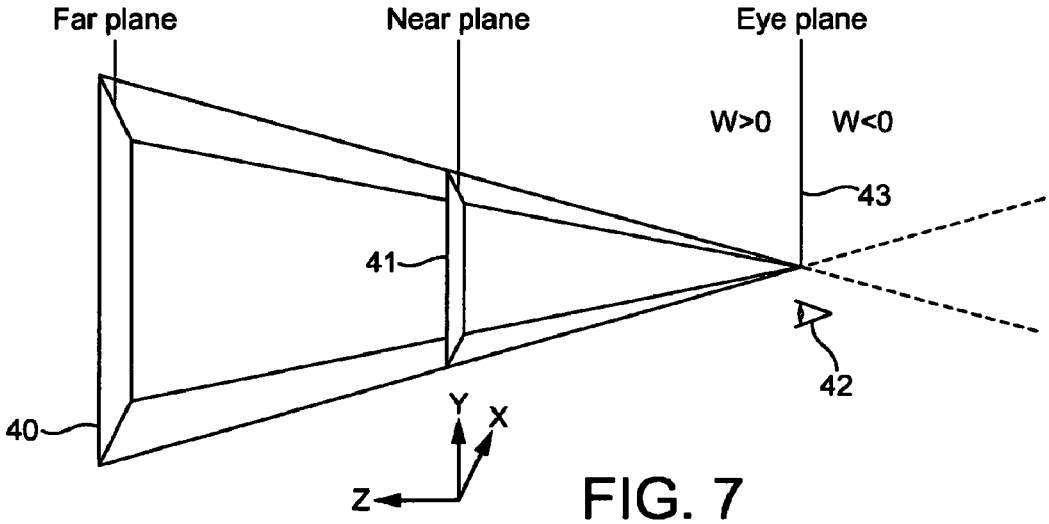
FIG. 7 shows schematically the far plane, near plane and eye-plane used in graphics processing.

FIG. 6 illustrates this. As shown in FIG. 6, for a primitive 30 having two vertices 31, 32 having positive values of W and a vertex 33 having a negative value of W, in accordance with the present invention, the signs of the edge function derived for the edge 34 extending between the vertices 31 and 32 (i.e., opposite to the vertex 33 having the negative value of W) are flipped. Also, the primitive's winding is flipped, since the primitive has one vertex that has a negative value of W.

The effect of these arrangements is that primitives that cause eye plane intersections can still be processed satisfactorily, without the need for any clipping in respect of primitives that intersect the eye plane.

The system also tests whether all of the vertices for a primitive have negative values of W, and if they do, the primitive is then discarded (culled).

As can be seen from the above, 3D graphics rendering can be performed without the need to perform any clipping between the transformation and lighting and rasterisation stages of the graphics processing. This provides reduced implementation complexity and improved performance as compared to arrangements in which clipping has to be performed. For example, by avoiding the need to perform geometric clipping, implementation complexity of the graphics processing and rendering pipeline is reduced.

Moreover, preferred embodiments at least can be shown to be robust with respect to the requirement that if two primitives share an edge, then they must produce the exact same edge equation, and if multiple edges pass through a vertex, then each edge must pass exactly through the same point, at least if the point is within the visible screen area, even in the presence of floating-point roundoff errors. This avoids and/or reduces potential pixel and/or fragment drop-outs and/or duplicates.

This is achieved in example embodiments by setting the left, right, top and bottom edge planes for the purposes of clipping to the maximum values that can be represented using floating-point format numbers in the graphics processing system (thereby effectively making the "guard band" around the actual viewport effectively infinite), snapping vertex positions to a grid of predefined vertex positions, and prioritising the precision of selected vertices when deriving edge functions for a given primitive.

Similarly, in respect of the depth near and far clipping planes, again those planes are set to the maximum floating-point number format that can be represented for Z in the graphics system, and each vertex is allowed to have a full floating-point Z value, but then fragments that have a Z value that falls outside the range zero to one are discarded by means of a depth test or by generating an edge for rasterisation testing at those values.

Finally, in respect of the eye-plane, in example embodiments, the need for clipping is avoided by instead modifying the edge equations generated for a primitive in dependence on the sign of the W value for each vertex of the primitive.

The invention claimed is:

1. A method of operating a graphics processing system when processing graphics primitives for display in which a clipping area defining left, right, top, and bottom edge planes within which a primitive must lie for processing is defined, the method comprising:

defining the x, y positions of vertices representing primitives to be processed for display in floating-point format;

a graphics processor snapping the x, y positions of vertices of primitives to be processed for display to respective vertex x, y positions from a set of plural vertex x, y positions defined for the processing of primitives;

the graphics processor using the vertex position in the set that a given vertex is snapped to as the x, y position of the vertex when deriving an edge function or the edge functions for an edge or the edges that includes the vertex; and setting respective x, y positions of the left, right, top and bottom edge planes defining the clipping area to the respective largest position values that can be represented in floating-point format in the graphics processing system.

2. The method of claim 1, wherein the set of plural vertex x, y positions defined for the processing of primitives comprises a regular grid of defined vertex x, y positions.

3. The method of claim 1, further comprising deriving an edge function defining an edge extending between two vertices by:

determining which of the two vertices that form the end points of the edge is closest to the screen-space origin;

determining the slope between the two vertices; and deriving the edge function for the edge defined by the two vertices as an edge function having the determined slope and passing through the vertex that is determined to be closest to the screen-space origin.

4. The method of claim 1, further comprising setting the depth values of the near and far planes for the purposes of a near and far plane clipping test to greater than the range 0 to 1.

5. The method of claim 1, further comprising modifying the edge functions generated for a primitive in dependence on the sign of an eye plane distance (W) value for a or each vertex of the primitive.

6. A method of deriving an edge function representing an edge extending between two vertices in a graphics processing system in which a clipping area defining top, bottom, left, and right edge planes within which a primitive must lie for processing is defined, the method comprising:

defining x, y positions of the two vertices in floating-point format;

determining the slope of the edge extending between the two vertices;

determining which of the two vertices is closest to a screen-space origin;

deriving the edge function as an edge having the determined slope and passing through the vertex determined to by closest to the screen-space origin; and setting respective x, y positions of the left, right, top, and bottom edge planes defining the area to the respective largest position values that can be represented in floating-point format in the graphics processing system.

7. A method of processing graphics primitives for display, in a system in which view frustum near and far depth planes having a defined range of depth values between them are defined, the method comprising:

setting the depth values of the near and far planes for the purposes of a clipping test to be respectively outside the view frustum near and far depth planes; and performing a clipping test in respect of Z values for vertices against the near and far planes defined for the clipping test, wherein the method further comprises setting the depth values of the near and far planes for the purposes of the clipping test to the respective maximum floating point number format depth (Z) values that the graphics processing system can use and support, and using a full floating-point number format depth (Z) value for vertices of primitives to be rendered.

8. The method of claim 7, comprising subsequently discarding any fragments having depth values falling outside a range of depth values of zero to one.

9. A method of processing a graphics primitive in a graphics processing system, in which the graphics primitive is defined by a plurality of vertices, and each vertex has associated with it a W-value representing the distance of the vertex from the eye-plane, the method comprising:

deriving the edge functions for each edge of the primitive; and modifying the edge functions generated for the primitive in dependence on the sign of the W value for a or each vertex of the primitive, wherein the step of modifying the edge functions generated for the primitive in dependence on the sign of the W value for each vertex of the primitive comprises:

for each of the vertices of the primitive that has a negative value of W, flipping the signs of the edge function derived for the opposing edge of primitive; and if an odd number of the vertices of the primitive have negative values of W, flipping the winding of the primitive for the purpose of determining whether the primitive is front-facing or back-facing.

10. A graphics processing apparatus for processing graphics primitives for display in which a clipping area defining left, right, top and bottom edge planes within which a primitive must lie for processing is defined, the apparatus comprising:

processing logic configured to define the x, y positions of vertices representing primitives to be processed for display in floating-point format;

processing logic configured to snap the x, y positions of vertices of primitives to be processed for display to respective vertex x, y positions from a set of plural vertex x, y positions defined for the processing of primitives;

processing logic configured to use the vertex position in the set that a given vertex is snapped to, as the x, y position of the vertex when deriving an edge function or the edge functions for an edge or the edges that include the vertex, processing logic configured to set the respective x, y positions of the left, right, top, and bottom edge planes defining the clipping area to the respective largest position values that can be represented in floating-point format in the graphics processing system.

11. The apparatus of claim 10, wherein the set of plural vertex x, y positions defined for the processing of primitives comprises a regular grid of defined vertex x, y positions.

12. The apparatus of claim 10, further comprising processing logic configured to derive an edge function defining an edge extending between two vertices by:

determining which of the two vertices that form the end points of the edge is closest to the screen-space origin;

determining the slope between the two vertices; and deriving the edge function for the edge defined by the two vertices as an edge function having the determined slope and passing through the vertex that is determined to be closest to the screen-space origin.

13. The apparatus of claim 10, further comprising processing logic configured to set the depth values of the near and far planes for the purposes of a near and far plane clipping test to greater than the range 0 to 1.

14. The apparatus of claim 10, further comprising processing logic configured to modify the edge functions generated for a primitive in dependence on the sign of an eye plane distance (W) value for a or each vertex of the primitive.

15. An apparatus for deriving an edge function representing an edge extending between two vertices in a graphics processing system in which a clipping area defining top, bottom, left and right edge within which a primitive must lie for processing is defined, the apparatus comprising:

processing logic configured to define x, y positions of the two vertices in floating-point format;

processing logic configured to determine the slope of the edge extending between the two vertices;

processing logic configured to determine which one of the two vertices is closest to a screen-space origin;

processing logic configured to derive the edge function as an edge having the determined slope and passing through the vertex that is determined to be closest to the screen-space origin; and processing logic configured to set the respective x, y positions of the left, right, top, and bottom edge planes defining the clipping area to the respective largest position values that can be represented in floating-point format in the graphics processing system.

16. An apparatus for processing graphics primitives for display, in a graphics processing system in which view frustum near and far depth planes having a defined range of depth values between them are defined, the apparatus comprising:

processing logic configured to set the depth values of the near and far planes for the purposes of a clipping test to be respectively outside the view frustum near and far depth planes; and processing logical configured to perform a clipping test in respect of Z values for vertices against the near and far planes defined for the clipping test, wherein the apparatus further comprises comprising processing logic configured to set the depth values of the near and far planes for the purposes of the clipping test to the respective maximum floating point number format depth (Z) values that the graphics processing system can use and support, and processing logic configured to use a full floating-point number format depth (Z) value for vertices of primitives to be rendered.

17. The apparatus of claim 16, comprising processing logic configured to subsequently discard any fragments having depth values falling outside a range of depth values of zero to one.

18. A graphics processing apparatus for processing a graphics primitive in a graphics processing system, in which the graphics primitive is defined by a plurality of vertices, and each vertex has associated with it a W-value representing the distance of the vertex from the eye-plane, the apparatus comprising:

processing logic configured to derive the edge function for each edge of the primitive; and processing logic configured to modify the edge functions generated for the primitive in dependence on the sign of the W value for a or each vertex of the primitive, wherein the processing logic is configured to modify the edge functions generated for the primitive in dependence on the sign of the W value for each vertex of the primitive by performing the following:

for each of the vertices of the primitive that has a negative value of W, flip the signs of the edge function derived for the opposing edge of primitive; and if an odd number of the vertices of the primitive have negative values of W, flip the winding of the primitive for the purpose of determining whether the primitive is front-facing or back-facing.

19. A computer program product comprising computer software instructions stored on a non-transitory storage medium which when executed on a data processor cause the data processor to carry out the method of claim 1.

* * * * *